United States Patent [19]

Lindsay

[11] Patent Number: 4,993,551

[45] Date of Patent: Feb. 19, 1991

[54] TOOL HOLDER FOR BUCKET

[76] Inventor: Brian K. Lindsay, Box 267K, Braddock Ave., Hammonton, N.J. 08037

[21] Appl. No.: 395,815

[22] Filed: Aug. 18, 1989

[51] Int. Cl.[5] ..... B65D 85/20; B65D 30/22

[52] U.S. Cl. ..... 206/373; 220/500; 383/39; 383/7; 150/161

[58] Field of Search ..... 206/373, 372, 374; 220/23.4, 23.2, 23.8, 23.83, 23.86; 383/38, 39, 7; 150/161; 53/449; 29/454, 455.1, 469

[56] References Cited

U.S. PATENT DOCUMENTS

| | | | |
|---|---|---|---|
| D. 222,951 | 2/1972 | Stringer | D49/34 |
| 413,526 | 10/1889 | Light | 220/23.4 |
| 733,542 | 8/1903 | Converse . | |
| 2,405,517 | 8/1946 | Plummer | 383/39 |
| 2,533,355 | 12/1950 | Comfort | 211/65 |
| 2,594,176 | 4/1952 | Kaiser, Jr. | 15/264 |
| 2,758,798 | 8/1956 | Schmidt | 206/373 |
| 3,187,903 | 6/1965 | Ohz | 383/38 X |
| 3,967,666 | 7/1976 | Farrar | 383/7 |
| 4,356,854 | 11/1982 | McGee | 383/104 |
| 4,362,243 | 12/1982 | Deyesso et al. | 206/373 |
| 4,765,472 | 8/1988 | Dent | 206/373 |
| 4,826,007 | 5/1989 | Skeie | 206/373 |

FOREIGN PATENT DOCUMENTS 2035067 6/1980 United Kingdom .

*Primary Examiner*—Steven N. Meyers
*Assistant Examiner*—Jacob K. Ackun, Jr.
*Attorney, Agent, or Firm*—Thomas A. Lennox

[57] ABSTRACT

A tool holder and storage device to interfit over the upper rim of a five gallon bucket is provided. The device includes a tubular cloth panel which drapes and conforms over the inside and outside surfaces of the bucket with inner pockets sewn on the panel to drape on the inside of the bucket and outer pockets sewn on the panel to drape on the outside surface of the bucket with slots cut lengthwise from an end of the cloth panel of sufficient length to allow the panel to drape downwardly around the handle ends of the bucket on the outside surface with ties between the edges of the slots to fix the device under the handle ends.

24 Claims, 3 Drawing Sheets

TOOL HOLDER FOR BUCKET

BACKGROUND OF THE INVENTION

This invention involves a tool holder and more specifically a tool holder and storage device which interfits and hangs over the rim of a bucket equipped with a handle.

For carpenters and other tradesman, it is necessary to carry a wide variety of tools to and from the work site each day. It is also desirable to have those tools readily available in an organized fashion for use at the work site. One of the common devices utilized by carpenters and other tradesman are plastic five gallon buckets that are typically empty containers that originally contained paste or paint. The buckets are used to carry spare parts and various fastening devices either in small boxes or in bulk. One answer has been to pile the tools into the bucket on top of the small parts but this is totally unsatisfactory from an organization and use standpoint. The other alternative is to carry a separate tool box together with a bucket with the small parts and fasteners in the bucket. That is also inconvenient and is a considerable additional bother to carry.

A number of varying devices have been provided to carry tools such as the belt with pockets as well as various kinds of tool chests, but none of the devices satisfy the above needs and attain the objects described hereinbelow.

SUMMARY OF THE INVENTION

It is an object of the present invention to provide a tool holder and storage device to interfit over the upper rim of a bucket to drape downwardly and conform to the surfaces of the outside of the bucket and to the inside of the bucket.

It is a particular object of the present invention to provide a tool holder and storage device which can utilize a bucket to support the tool holding device as well as utilizing the bottom of the bucket to provide an additional open storage area and carrying area for small parts, fastening devices and other materials.

It is an additional object of the present invention to provide a tool holder device suitable not only for the tradesperson, but also handy and useful for the homeowner to facilitate the storage of tools and eliminate the necessity of having to go up and down stairs to get tools, special parts and the like when carrying out a task around the home.

It is a specific object of the present invention to provide a tool holder device that will hold varying sized tools providing access to them at various positions in separate pockets of the tool holding device.

It is a particular object of the present invention to provide a tool holding device that holds tools not only on the inside of the surface of the bucket, but also holds tools on the outside surface of the bucket.

The invention is tool holder device to interfit over a bucket that includes an upper rim, an inside surface, an outside surface, a top opening and a carrying handle extending across the top opening and attaching at two areas on the outside surface of the bucket. The device is to drape downwardly over the upper rim and conform to the surfaces of the inside of the bucket and of the outside of the bucket. The device includes a tubular panel of drapable sheet material that includes a circumference proximate the circumference of the bucket, a length, a first end edge and a second end edge, and a first face all being of the tubular panel. The device further includes first pockets to drape on the inside surface of the bucket formed of the panel that includes a first flexible sheet panel section positioned with one edge aligned with the first end edge and overlapping a portion of the first face, and a plurality of first stitching means each that includes a lengthwise line of attachment between the first section and the panel to form a plurality of inner pockets opening toward the second end edge along a line around the circumference of the panel. The device also includes opening means that includes at least two openings cut through the panel of sufficient size and shape to allow the second end edge of the panel to drape downwardly on the outside surface of the bucket around the two areas of attachment of the handle.

It is preferred that the device further include second pockets to drape on the outside surface of the bucket formed of the panel that include a second flexible sheet section positioned with one edge aligned with the second end edge and overlapping a portion of the first face, and a plurality of second stitching means each that includes a lengthwise line of attachment between the second flexible sheet section and the panel to form a plurality of second pockets opening toward the first end along a line around the circumference of the panel. It is further preferred that the opening means include at least two slots cut lengthwise through panel opening at one end from the second end edge. It is also preferred that the device further include tie means attached on opposite sides of each of the two slots to pull the slots together when the tie means are attached. It is further preferred that the tubular drapable sheet panel be a flat panel, with a width proximate the circumference of the bucket, two lengthwise edges, and lengthwise stitching means to connect the two lengthwise edges along the length. It is also preferred that the device further include a plurality of third pockets positioned on the first face of the panel proximate the first pockets, opening in the same direction as the first pockets, and disposed transverse across the circumference of the panel. It is further preferred that the there be a multiplicity of both first and second pockets. It is also preferred that the the first flexible sheet section have a length proximate the circumference of the panel and the first flexible sheet section be aligned with its length transverse across the circumference of the panel. It is also preferred that the first flexible sheet section be a section of the panel folded from the first end edge overlapping a portion of the front face. It is further preferred that the second flexible sheet section be a section of the panel folded from the second end edge overlapping a portion of the front face. It is also preferred that the first flexible sheet section be a section of the panel folded from the first end edge overlapping a portion of the front face and the second flexible sheet section be a section of the panel folded from the second end edge overlapping a portion of the front face. It is further preferred that the stitching means be threaded stitching.

The invention is also a tool holder device to interfit over an upper rim of a bucket to drape downwardly and conform to the surfaces of the outside of the bucket and of the inside of the bucket. The device includes a flat drapable sheet panel that includes a width proximate the circumference of the bucket, a length with two lengthwise edges, a first and a second end edge, and a front face. The device further includes first pockets to drape on the inside surface of the bucket formed of the drapable sheet panel that include a first flexible sheet section positioned with one edge aligned with the first end edge and overlapping a portion of the front face, and a plurality of first stitching means that includes a lengthwise line of attachment between the first flexible sheet section and the panel to form a plurality of first pockets opening toward the second end along a line transverse across the width of the panel. The device also includes second pockets to drape on the outside surface of the bucket formed of the drapable sheet panel that include a second flexible sheet section positioned with one edge aligned at least contiguous with the second end edge and overlapping a portion of the front face, and a plurality of second stitching means each that includes a lengthwise line of attachment between the second flexible sheet section and the panel to form a plurality of second pockets opening toward the first end along a line transverse across the width of the panel. The device further includes at least two slots cut lengthwise through the second section and the panel opening at one end from the second end edge, and lengthwise stitching means to connect the two lengthwise edges of the flat sheet panel along the length.

It is preferred that the device further include tie means attached on opposite sides of each of the two slots to pull the slots together when the tie means are attached. It is further preferred that the the first flexible sheet section have a length proximate the width to panel and the first flexible sheet section is aligned with its length transverse across the width of the panel.

The invention is also a tool holder device to interfit over an upper rim of a bucket to drape downwardly and conform to the surfaces of the outside of the bucket and of the inside of the bucket. The device includes a flat drapable sheet panel that includes a width proximate the circumference of the bucket, a length with two lengthwise edges, a first and a second end edge, and a front face. The device further includes first pockets to drape on the inside surface of the bucket formed of the drapable sheet panel that include a first section of the panel folded from the first end edge overlapping a portion of the front face, and a plurality of first stitching means each that includes a lengthwise line of attachment between the first section and panel to form a plurality of first pockets opening toward the second end along a line transverse across the width of the panel. The device further includes second pockets to drape on the outside surface of the bucket formed of the drapable sheet panel that include a second section of the panel folded from the second end edge overlapping a portion of the front face, and a plurality of second stitching means each that includes a lengthwise line of attachment between the second section and panel to form a plurality of second pockets opening toward the first end along a line transverse across the width of the panel. The device also includes at least two slots cut lengthwise through the second section and the panel opening at one end from the second end edge, and lengthwise stitching means to connect the two lengthwise edges of the flat panel along the lenght.

The invention also includes a method of storing tools that includes providing a bucket that includes an upper rim, an inside surface, an outside surface, a top opening and a carrying handle extending across the top opening and attaching at two areas on the outside surface of the bucket. The method further includes providing a tubular panel of drapable sheet material that includes a width proximate the circumference of the bucket, a length, a first end edge and a second end edge, and a first face. The method further includes providing first pockets to drape on the inside surface of the bucket formed of the panel that includes positioning a first flexible sheet panel section with one edge aligned with the first end edge and overlapping a portion of the first face, and attaching a plurality of first stitching means each that includes a lengthwise line of attachment between the first section and the panel to form a plurality of first pockets opening toward the second end edge along a line around the circumference of the panel. The method further includes cutting opening means that includes at least two openings cut through the panel of sufficient size and shape to allow the panel to drape downwardly on the outside surface of the bucket around the two areas of attachment of the handle, and draping the tubular drapable sheet panel downwardly with the first face facing outwardly from the upper rim and conform to the surfaces of the inside of the bucket and of the outside of the bucket.

It is preferred that the method further include providing second pockets to drape on the outside surface of the bucket formed of the panel that includes positioning a second flexible sheet section with one edge aligned with the second end edge and overlapping a portion of the first face, and applying a plurality of second stitching means each that includes a lengthwise line of attachment between the second flexible sheet section and the panel to form a plurality of second pockets opening toward the first end along a line around the circumference of the panel. It is preferred that the cutting the opening means further includes cutting at least two slots lengthwise through panel each opening at one end from the second end edge. It is preferred that the method further include providing tie means on opposite sides of each of the two openings and pulling the openings together with the tie means under the areas of handle attachment on the outside surface of the bucket. It is preferred that the providing the first pockets include folding a section of the tubular panel from the first end edge forming the first flexible sheet section overlapping a portion of the front face and the providing the second pockets include folding a section of the tubular panel from the second end edge forming the second flexible sheet section overlapping a portion of the front face. It is preferred that the method further include providing a plurality of third pockets positioned on the first face of the tubular panel proximate the first pockets, opening in the same direction as the first pockets, and disposed transverse around the circumference of the panel.

The invention is also a method of storing tools that includes providing a bucket that includes an upper rim, an outside surface, an inside surface, and a handle with lower ends connecting into the outside surface. The method further includes providing a flat drapable sheet panel that includes a width proximate the circumference of the bucket, a length with two lengthwise edges, a first and a second end edge, and a front face. The method also includes providing first pockets on the drapable sheet panel to drape on the inside surface of the bucket that include a first flexible sheet section positioned with one edge aligned at least contiguous with first end edge and overlapping a portion of the front face, and a plurality of first stitching means including a lengthwise line of attachment between the first flexible sheet section and the panel to form a plurality of first pockets opening toward the second end along a line transverse across the width of the panel. The method further includes providing second pockets on the drapable sheet panel to drape on the outside surface of the bucket that include a second flexible sheet section positioned with one edge aligned at least contiguous with the second end edge and overlapping a portion of the front face, and a plurality of second stitching means each including a lengthwise line of attachment between the second flexible sheet section and the panel to form a plurality of outer pockets opening toward the first end along a line transverse across the width of the panel. The method also includes cutting at least two slots lengthwise through the second section and the panel opening at one end from the second end edge, and lengthwise stitching the two lengthwise edges of the flat panel along the length. The method further includes draping the drapable sheet panel over the upper rim of a bucket to drape downwardly and conform to the surfaces of the outside of the bucket and of the inside of the bucket, while aligning the slots with the handle connections to the bucket.

DESCRIPTION OF PREFERRED EMBODIMENTS

Figure 1:
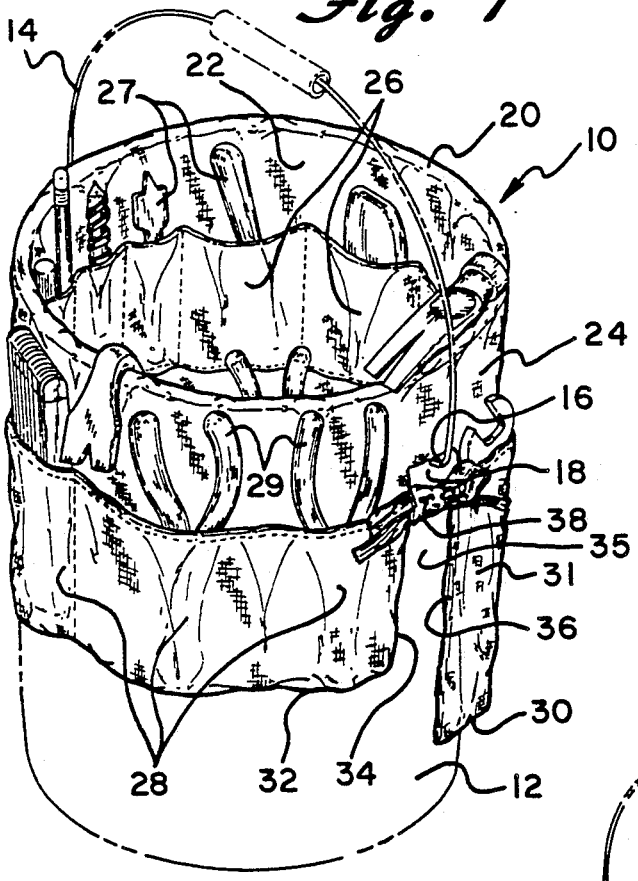
FIG. 1 is a perspective view of the hand tool storage device of the present invention supported on a shadow view of a bucket.
Figure 2:
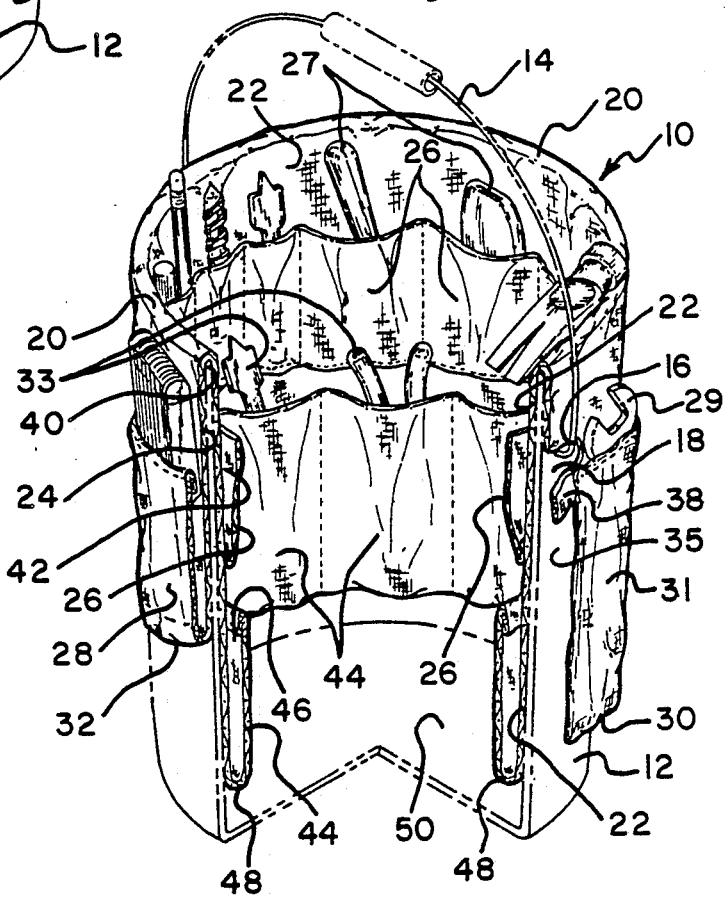
FIG. 2 is a perspective view with a partial vertical cut-away of the bucket and the device illustrated in FIG. 1.

In FIGS. 1 and 2, tool holder device 10 is shown draped over and supported by five gallon, non-tapered bucket 12 which can be any common bucket typically available to the craftsman and for home use. Metal handle 14 extends across the opening and downwardly over the outside surface of the bucket to median area position 18 on the outside surface of the bucket where lower ends 16 of handle 14 engage in and attach to the bucket side wall. Typically, although not pictured here, the plastic buckets include a heat welded raised section molded out of a plastic which house the ends of the handle and allow the handle to rotate in the vertical plane. With these raised sections, device 10 attaches even more securely as the ties, described herein below, engage the raised portions on the bucket and secure the device on the bucket. The diameter of the bucket is typically about 12 inches and such buckets commonly have reinforcing ribs around the upper edge of the bucket which further facilitate attachment of the device. Tool holder 10 includes a main tubular pliant and drapable cloth panel which drapes over the upper rim of the bucket and extends downwardly essentially covering the inside surface of bucket 12. That same piece of cloth, drapes over the outside surface of bucket 12, covering a major portion of that surface. This one piece of cloth as well as the balance of the material used to construct device 10 is heavy cotton duck fabric. Other durable drapable sheet or film materials that may be used include plastic film, such as unreinforced and reinforced plasticized polyvinyl chloride film and other synthetic materials. Of course, other woven fabrics, particularly polyolefins are satisfactory. This main piece of cloth in the form of a tube drapes over the upper rim of the bucket at section 20 essentially molding to the shape of the bucket upper rim. The cloth drapes over the inside surface as inside panel 22 which drops downwardly close to bottom 50 of bucket 12 terminating at lower end 48 where it is folded continues upwardly to form lower inner pockets 44. Continuing to refer to FIGS. 1 and 2, the latter being a partial cutaway of device 10 and bucket 12, the same main body of cloth, extends downwardly from section 20 of the cloth over the outside surface of bucket 12 as section 24, terminating proximate the lower edge of the outside surface of bucket 12. Upper third pockets 26 are sewn onto panel 22 to hold tools 27. In this embodiment, patch pockets 26 are relatively shallow to hold smaller tools which are more easily located and stored close to the upper rim of bucket 12. Second pockets 28 are formed as a turned-up, folded-over extension of the main piece of fabric as section 24 terminating at lower edge 32. Slot 35 is formed in device 10 which is vertically disposed to allow panel 24 to avoid the obstruction of handle end 16 so that panel 24 can extend downwardly past that height to form pockets 28 as well as pockets 31 on the opposite side of the vertical slot. Outer pockets 31 are formed by extending fabric section 24 downwardly to a height lower than lower edge 32 to terminate at lower edge 30 where the cloth is folded upwardly on the outside to form pockets 31. Vertical slot 35 in panel 24 terminates at vertical edge 34 on the side with pockets 28 and on vertical edge 36 on the opposite side with pockets 31. Thus, fabric section 24 is essentially divided in two parts, one on one side of the handle connection ends 16 and one on the other. To detachably attach device 10 to bucket 12, fabric ties 38 are attached on edges 34 and 36 and are of a sufficient length to be knotted and tied below bucket handle lower ends 16 thus securing device 10 to bucket 12. In FIG. 2, with the partial cut-away view, it is possible to view upper rim 40 of bucket 12 over which the main fabric drapes at section 20. Pocket opening 42 of pocket 26 opens upwardly to allow tools 27 to be stored, easily removed, and easily returned to a pocket. In this view, lower first pockets 44 are shown which terminate at lower inner edge 48 very close to bottom 50 of bucket 12.

Figure 3:
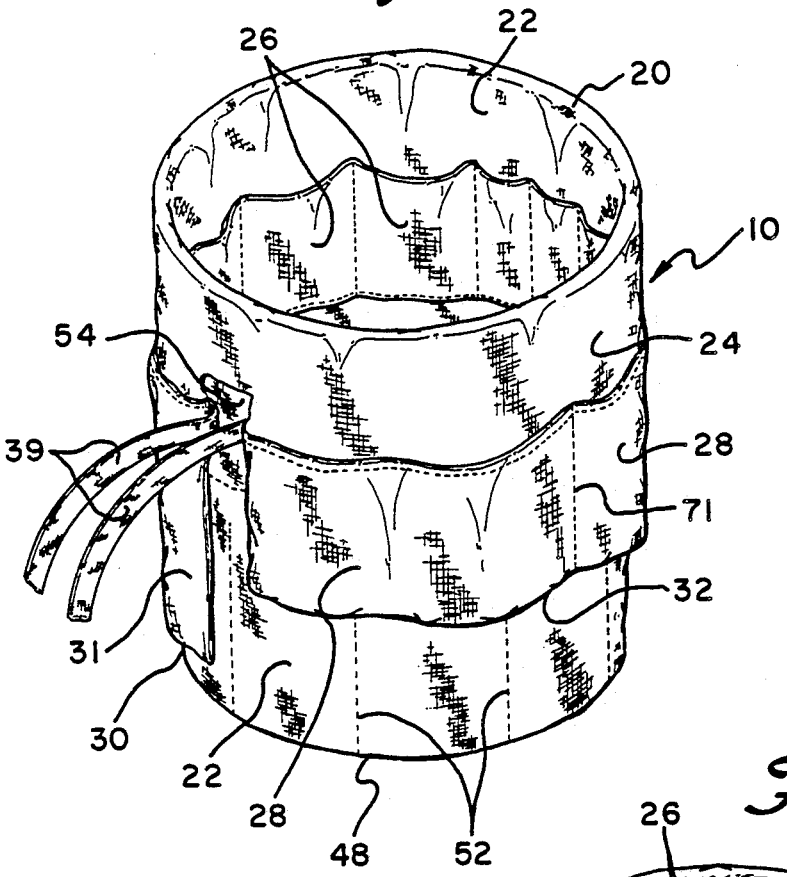
FIG. 3 is a perspective view of the device illustrated in FIG. 1 with the bucket removed and viewing the device from the left rear.
Figure 4:
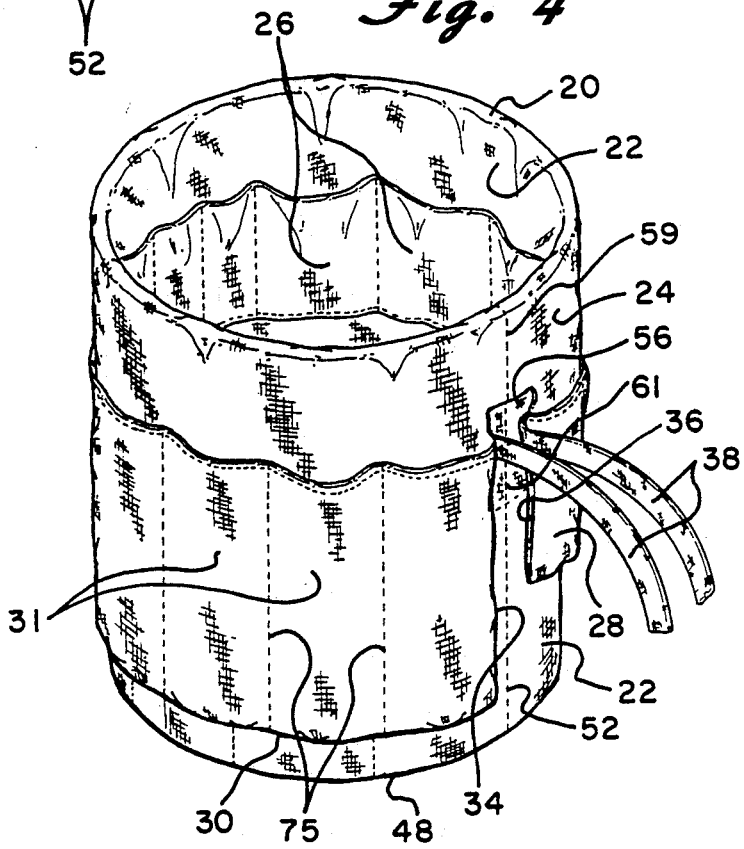
FIG. 4 is a perspective view of the device illustrated in FIG. 3 rotated counter clockwise 90 degrees.
Figure 5:
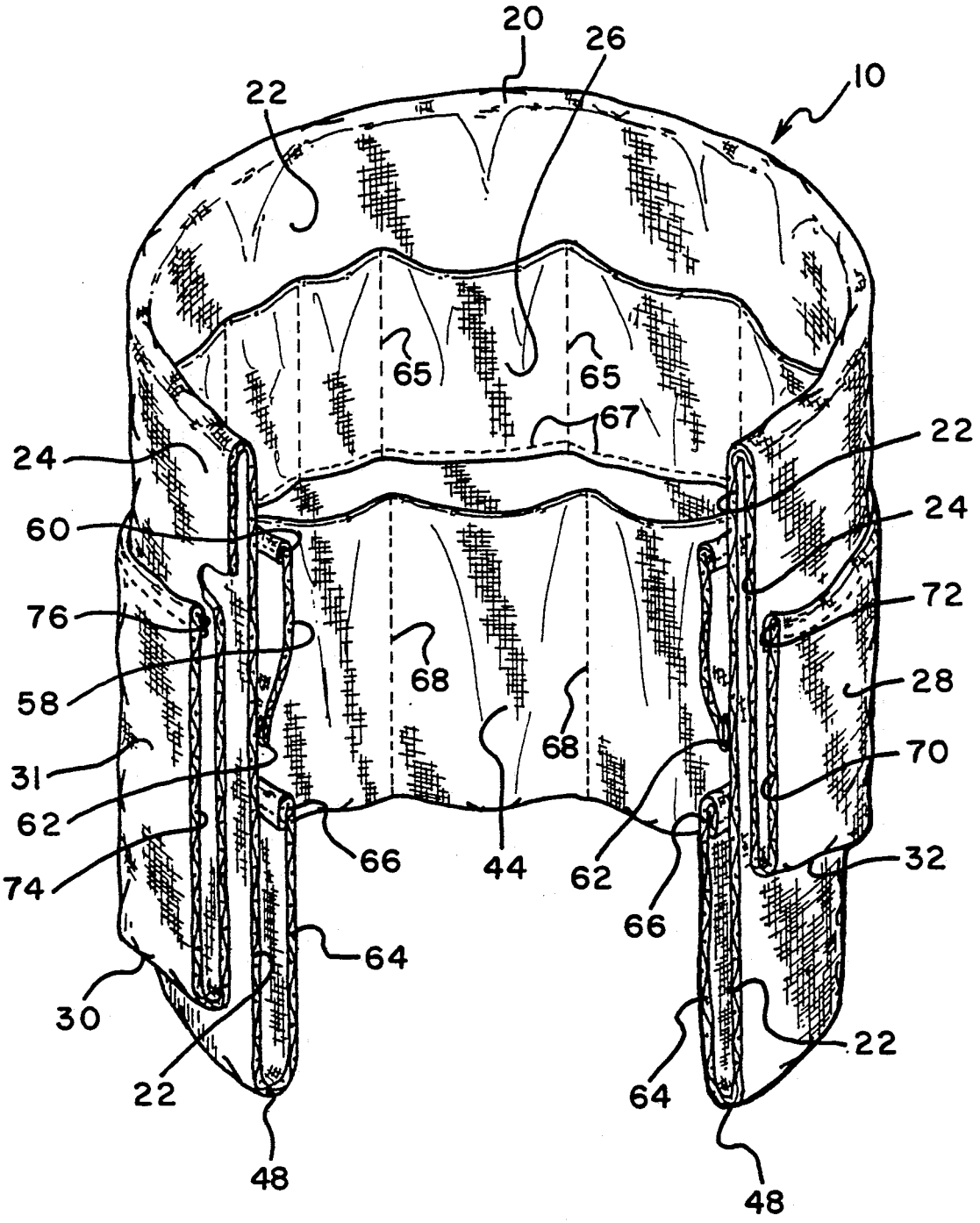
FIG. 5 is an enlarged perspective view with a partial vertical cut away of the device as illustrated in FIG. 4.

In FIG. 3, where device 10 has now been rotated 180 degrees horizontally, slot opening 54 is now displayed closable with ties 39 extending from each vertical edge of slot 54. Ties 39 provide multiple functions, including pulling the cloth taut to conform to the outside surface of the bucket and also to engage the bottom of the handle 14 at positions 24 to prevent the device from sliding off the top of the bucket or sliding in one direction or another, into the bucket or off the outside of the bucket. Stitch lines 52 are displayed on this side which form the vertical edges of pockets 44. In FIG. 4, which has been rotated 90 degrees counter-clockwise from FIG. 3, outer long pockets 31 are displayed terminating at lower edge 30, which is close in height to lower edge 48. Vertical slot opening 56 is bounded by vertical edges 34 and 36 and closed with ties 38. The continuous panel as illustrated in FIGS. 1 through 4 is a tubular panel having a diameter of about 12 to 13 inches formed by providing a panel of cloth with lengthwise edges which are sewn together along stitching line 59 which extends along panel section 22 as stitching line 61 and continues as stitching line 52' which doubles to form the lower pockets 44. The tubular cloth may be woven as a tubular section directly without the necessity of the lengthwise stitching. In the expanded view of FIG. 5, the construction of upper patch pockets 26 are shown formed by a horizontally disposed strip of cloth sewn onto panel 22 terminating at bottom edge 62 and upper edge of the pockets 60. Vertical stitching 65 separates the strip of cloth into pockets 26 and lower stitching 67 attaches lower edge 62 to panel 22. Lower pockets 44 are formed by an upturned, folded over continuation of the main body of cloth at section 64 which is folded upwardly and facing panel 22 from lower edge 48. Vertical stitching 68 not only holds upturned panel 64 in position, but also separates pockets 44. Likewise, pockets, 28 are formed on the outside surface from panel 24 by turning cloth section 70 upwardly to face panel 24. Vertical stitching 71 shown on FIG. 3 and hidden in this view, hold panel 70 in a vertical position and separate pockets 28 from each other. The upper end of panel 70 terminates at upper edge 72 at the openings of pockets 28. Likewise, on the opposite side of the outside sections of device 10, the main body of cloth is turned upwardly to form section 74 facing on the outside of section 24. Vertical stitching 75, shown on FIG. 4, is hidden in this view and holds section 74 in a vertical position as well as separating pockets 31. Panel section 74 terminates at upper edge 76 at the openings of pockets 31. All of the stitching used, not only to form the pockets but also to form the tubular cloth main panel of the device, may be threaded stitching, such as with nylon thread, or it may be replaced with other forms of attachment. If thermoplastic polymers are used, heat sealing of the seams may be sufficient. Further, metal or plastic rivets or staples may be utilized to attach the parts together and to form the pockets. Ties 38, which are used to pull the openings together and to engage the handle ends, may be straps attached with VELCRO hook and loop fabric attachment pieces or by hooks and eyes or any other suitable fastening device. The strap ties may be replaced by hooks and eyes extending from one side of the opening to the other again pulling the fabric taut and engaging the fabric under the ends of the handle. Although this embodiment shows a single line of second pockets and two rows, upper third and lower, of pockets, an additional row of pockets to drope on the outside of the bucket and an additional row of pockets to drope on the inside of the bucket may be added. The only limitation is the area of surfaces of the outside and inside of the bucket and the number of vertical stitch lines to separate the pockets.

While this invention has been described with reference to the specific embodiments disclosed herein, it is not confined to the details set forth and the patent is intended to include modifications and changes which may come within and extend from the following claims.

I claim:

1. A tool holder device to interfit over a bucket comprising an upper rim, an inside surface, an outside surface, a top opening and a carrying handle extending across the top opening and attaching at two areas on the outside surface of the bucket, the device to drape downwardly over the upper rim and conform to the surfaces of the inside of the bucket and of the outside of the bucket, the device comprising:

(a) a tubular panel of drapable sheet material comprising:

(i) a circumference of the tubular panel proximate the circumference of the bucket, (ii) a length of the tubular panel, (iii) a first end edge and a second end edge, both of the tubular panel, and (iv) a first face of the tubular panel, (b) first pockets on the panel comprising:

(i) a first flexible sheet panel section positioned with one edge aligned with the first end edge and overlapping a portion of the first face, and (ii) a plurality of first stitching means each comprising a lengthwise line of attachment between the first section and the panel to form a plurality of first pockets opening toward the second end edge along a line around the circumference of the panel, (c) opening means comprising at least two openings cut through the panel of sufficient size and shape to allow the second end edge of the panel to drape downwardly on the outside surface of the bucket around the two areas of attachment of the handle, and (d) tie means attached on opposite sides of the each of the two openings to pull the openings together under the areas of attachment of the handle on the outside surface of the bucket.

2. The device of claim 1 wherein the openings comprise two slots cut lengthwise through panel opening at one end from the second end edge.

3. The device of claim 1 wherein the tubular drapable sheet panel further comprises a flat panel, with a width proximate the circumference of the bucket, two lengthwise edges, and lengthwise stitching means to connect the two lengthwise edges along the length.

4. The device of claim 1 wherein the first flexible sheet section has a length proximate the circumference of the panel and the first flexible sheet section is aligned with its length transverse across the circumference of the panel.

5. The device of claim 1 wherein the first flexible sheet section is a section of the panel folded from the first end edge overlapping a portion of the front face.

6. The device of claim 1 wherein the stitching means comprises threaded stitching.

7. A tool holder device to interfit over an upper rim of a bucket to drape downwardly and conform to the surfaces of the outside of the bucket and of the inside of the bucket, the device comprising:

(a) a flat drapable sheet panel comprising:

(i) a width proximate the circumference of the bucket, (ii) a length with two lengthwise edges, (iii) a first and a second end edge, and (iv) a front face, (b) first pockets on the drapable sheet panel comprising:

(i) a first flexible sheet section positioned with one edge aligned with the first end edge and overlapping a portion of the front face, and (ii) a plurality of first stitching means comprising a lengthwise line of attachment between the first flexible sheet section and the panel to form a plurality of first pockets opening toward the second end along a line transverse across the width of the panel, (c) second pockets on the drapable sheet panel comprising:

(i) a second flexible sheet section positioned with one edge aligned at least contiguous with the second end edge and overlapping a portion of the front face, and (ii) a plurality of second stitching means each comprising a lengthwise line of attachment between the second flexible sheet section and the panel to form a plurality of second pockets opening toward the first end along a line transverse across the width of the panel, (d) at least two slots cut lengthwise through the second section and the panel opening at one end from the second end edge, and (e) lengthwise stitching means to connect the two lengthwise edges along the length.

8. The device of claim 1 further comprising a plurality of third pockets positioned on the panel proximate the first pockets, opening in the same direction as the first pockets, and disposed transverse across the width of the panel.

9. The device of claim 7 further comprising tie means attached on opposite sides of the two slots to pull the slots together when the tie means are attached.

10. The device of claim 7 wherein the first flexible sheet section has a length proximate the width to panel and the first flexible sheet section is aligned with its length transverse across the width of the panel.

11. A tool holder device to interfit over an upper rim of a bucket to drape downwardly and conform to the surfaces of the outside of the bucket and of the inside of the bucket, the device comprising:

(a) a flat drapable sheet panel comprising:

(i) a width proximate the circumference of the bucket, (ii) a length with two lengthwise edges, (iii) a first and a second end edge, and (iv) a front face, (b) first pockets on the drapable sheet panel comprising:

(i) a first section of the panel folded from the first end edge overlapping a portion of the front face, and (ii) a plurality of first stitching means each comprising a lengthwise line of attachment between the first section and panel to form a plurality of first pockets opening toward the second end along a line transverse across the width of the panel, (c) second pockets on the bucket formed of the drapable sheet panel comprising:

(i) a second section of the panel folded from the second end edge overlapping a portion of the front face, and (ii) a plurality of second stitching means each comprising a lengthwise line of attachment between the second section and panel to form a plurality of second pockets opening toward the first end along a line transverse across the width of the panel, (d) at least two slots cut lengthwise through the second section and the panel opening at one end from the second end edge, and (e) lengthwise stitching means to connect the two lengthwise edges along the length.

12. The device of claim 11 further comprising a plurality of third pockets positioned on the panel proximate the first pockets, opening in the same direction as the first pockets, and disposed transverse across the width of the panel.

13. A tool holder device to interfit over a bucket comprising an upper rim, an inside surface, an outside surface, a top opening and a carrying handle extending across the top opening and attaching at two areas on the outside surface of the bucket, the device to drape downwardly over the upper rim and conform to the surfaces of the inside of the bucket and of the outside of the bucket, the device comprising:

(a) a tubular panel of drapable sheet material comprising:

(i) a circumference of the tubular panel proximate the circumference of the bucket, (ii) a length of the tubular panel, (iii) a first end edge and a second end edge, both of the tubular panel, and (iv) a first face of the tubular panel, (b) first pockets on the panel comprising:

(i) a first flexible sheet panel section positioned with one edge aligned with the first end edge and overlapping a portion of the first face, and (ii) a plurality of first stitching means each comprising a lengthwise line of attachment between the first section and the panel to form a plurality of first pockets opening toward the second end edge along a line around the circumference of the panel, (c) opening means comprising at least two openings cut through the panel of sufficient size and shape to allow the second and edge of the panel to drape downwardly on the outside surface of the bucket around the two areas of attachment of the handle without having the first temporarily detach the handle from the bucket, and (d) second pockets on the panel comprising:

(i) a second flexible sheet section positioned with one edge aligned with the second end edge and overlapping a portion of the first face, and (ii) a plurality of second stitching means each comprising a lengthwise line of attachment between the second flexible sheet section and the panel to form a plurality of second pockets opening toward the first end along a line around the circumference of the panel.

14. The device of claim 13 further comprising a plurality of third pockets positioned on the first face of the panel proximate the first pockets, opening in the same direction as the first pockets, and disposed transverse across the circumference of the panel.

15. The device of claim 13 wherein there are a multiplicity of both first and second pockets.

16. The device of claim 13 wherein the second flexible sheet section is a section of the panel folded from the second end edge overlapping a portion of the front face.

17. The device of claim 13 wherein the first flexible sheet section is a section of the panel folded from the first end edge overlapping a portion of the front face and the second flexible sheet section is a section of the panel folded from the second end edge overlapping a portion of the front face.

18. A method of storing tools comprising:

(a) providing a bucket comprising an upper rim, an inside surface, an outside surface, a top opening and a carrying handle extending across the top opening and attaching at two areas on the outside surface of the bucket, (b) providing a tubular panel of drapable sheet material comprising:

(i) a circumference of the tubular panel proximate the circumference of the bucket,
(ii) a length of the tubular panel,
(iii) a first end edge and a second end edge, both of the tubular panel, and
(iv) a first face of the tubular panel, (c) providing first pockets on the panel comprising:
(i) positioning a first flexible sheet panel section with one edge aligned with the first end edge and overlapping a portion of the first face, and
(ii) attaching a plurality of first stitching means each comprising a lengthwise line of attachment between the first section and the panel to form a plurality of first pockets opening toward the second end edge along a line around the circumference of the panel, and (d) cutting at least two openings cut through the panel of sufficient size and shape to allow the panel to drape downwardly on the outside surface of the bucket around the two areas of attachment of the handle without having to first temporarily detach the handle from the bucket, and (e) draping the tubular drapable sheet downwardly with the first face facing outwardly from the inside surface of the bucket and from the outside surface of the bucket to conform to the surfaces of the inside of the bucket and of the outside of the bucket.

19. The method of claim 18 further comprising providing second pockets to drape on the outside surface of the bucket formed of the panel comprising:
(i) positioning a second flexible sheet section with one edge aligned with the second end edge and overlapping a portion of the first face, and
(ii) applying a plurality of second stitching means each comprising a lengthwise line of attachment between the second flexible sheet section and the panel to form a plurality of second pockets opening toward the first end along a line around the circumference of the panel.

20. The method of claim 18 wherein cutting the openings further comprises cutting at least two slots lengthwise through panel each opening at one end from the second end edge.

21. The method of claim 18 further comprising providing tie means on opposite sides of each of the two openings and pulling the openings together with the tie means under the areas of handle attachment on the outside surface of the bucket.

22. The method of claim 19 wherein the providing the first pockets comprises folding a section of the tubular panel from the first end edge forming the first flexible sheet section overlapping a portion of the front face and the providing the second pockets comprises folding a section of the tubular panel from the second end edge forming the second flexible sheet section overlapping a portion of the front face.

23. The method of claim 18 further comprising providing a plurality of third pockets positioned on the first face of the tubular panel proximate the first pockets, opening in the same direction as the first pockets, and disposed transverse around the circumference of the panel.

24. A method of storing tools comprising:

(a) providing a bucket comprising an upper rim, an outside surface, an inside surface, and a handle with lower ends connecting into the outside surface, (b) providing a flat drapable sheet panel comprising:
(i) a width proximate the circumference of the bucket,
(ii) a length with two lengthwise edges,
(iii) a first and a second end edge, and
(iv) a front face, (c) providing first pockets on the drapable sheet panel to drape on the inside surface of the bucket comprising:
(i) positioning a first flexible sheet section with one edge aligned with the first end edge and overlapping a portion of the front face, and
(ii) attaching a plurality of first stitching means comprising a lengthwise line of attachment between the first flexible sheet section and the panel forming a plurality of first pockets opening toward the second end along a line transverse across the width of the panel, (d) providing second pockets on the drapable sheet panel to drape on the outside surface of the bucket comprising:
(i) positioning a second flexible sheet section with one edge aligned with the second end edge and overlapping a portion of the front face, and
(ii) applying a plurality of second stitching means each comprising a lengthwise line of attachment between the second flexible sheet section and the panel to form a plurality of second pockets opening toward the first end along a line transverse across the width of the panel, (f) cutting at least two slots lengthwise through the second section and the panel opening at one end from the second end edge, (g) lengthwise stitching the two lengthwise edges along the length, and (h) draping the resulting tubular drapable sheet panel over the upper rim of a bucket to drape downwardly and conform to the surfaces of the outside of the bucket and of the inside of the bucket with the front face facing outwardly from the inside surface of the bucket and from the outside surface of the bucket, while aligning the opening means with the handle connections to the bucket.

* * * * *